US007360754B2

(12) United States Patent
Robbins

(10) Patent No.: US 7,360,754 B2
(45) Date of Patent: Apr. 22, 2008

(54) INTERLOCKING FENCE SYSTEM AND METHOD

(76) Inventor: Steven L. Robbins, 12111 Rockharbor La., Houston, TX (US) 77070

( * ) Notice: Subject to any disclaimer, the term of this patent is extended or adjusted under 35 U.S.C. 154(b) by 50 days.

(21) Appl. No.: 11/277,316

(22) Filed: Mar. 23, 2006

(65) Prior Publication Data

US 2007/0221903 A1 Sep. 27, 2007

(51) Int. Cl.
*E04H 17/00* (2006.01)

(52) U.S. Cl. ..... 256/65.12; 256/22; 256/65.11

(58) Field of Classification Search ..... 256/22, 256/65.01, 65.02, 65.11, 65.12, 70, 72; 403/353
See application file for complete search history.

(56) References Cited

U.S. PATENT DOCUMENTS

| | | | | |
|---|---|---|---|---|
| 485,268 | A * | 11/1892 | Flynn | 256/72 |
| 1,757,686 | A * | 5/1930 | Rosenbaum | 256/19 |
| 3,822,053 | A * | 7/1974 | Daily | 256/22 |
| 3,972,638 | A * | 8/1976 | Vivoli | 403/174 |
| 4,074,893 | A | 2/1978 | Coltrin | |
| 4,188,019 | A * | 2/1980 | Meredith | 256/24 |
| 4,667,935 | A | 5/1987 | Moore | |
| 4,898,365 | A * | 2/1990 | Conner et al. | 256/65.12 |
| 5,002,260 | A * | 3/1991 | Lustvee | 256/22 |
| 5,120,025 | A * | 6/1992 | D'Avanzo | 256/22 |
| 5,645,271 | A | 7/1997 | Nunez | |
| 5,882,001 | A * | 3/1999 | Reinbold | 256/22 |
| 6,345,809 | B1 * | 2/2002 | Bebendorf | 256/24 |
| 6,772,998 | B2 * | 8/2004 | Bebendorf | 256/24 |
| 6,779,781 | B2 * | 8/2004 | Bebendorf | 256/19 |
| 6,883,786 | B2 * | 4/2005 | Bebendorf | 256/19 |
| 7,021,607 | B1 | 4/2006 | Alexander | |

* cited by examiner

*Primary Examiner*—Daniel P. Stodola
*Assistant Examiner*—Joshua T Kennedy
(74) *Attorney, Agent, or Firm*—Daniel N. Lundeen; Lundeen & Dickinson, LLP

(57) ABSTRACT

An interlocking fence system is disclosed. Two spaced-apart upright posts (8, 10) attached to a grade G support a locking rail (4) with an offset locking aperture (26) and an alignment aperture (32) and further support an alignment rail (6) with an alignment aperture (40). A picket (2) has a locking slot (22) with an edge (28) of the locking aperture (26) in locking rail (4) serving as a tab to restrict axial movement when inserted therein. Alignment aperture (32) in the locking rail (4) and alignment aperture (40) in alignment rail (6) serve to restrict lateral movement of the picket (2). To support the rails (4, 6), retaining slots (24, 24') in the locking rail (4) and retaining slots (42, 42') in the alignment rail (6) can be retained by an edge (38, 50, 38', 50') in support apertures (12, 14, 16, 18) in the posts (8A, 10A).

20 Claims, 6 Drawing Sheets

INTERLOCKING FENCE SYSTEM AND METHOD

BACKGROUND

This invention relates to fencing, more particularly, to an interlocking fence system that can allow construction of a complete fence without welding or the use of screws, bolts, nails, rivets, pins, clips, brackets, rods, or other fasteners.

Building a fence, for example an ornamental iron fence, typically involves assembling panels of two major types. One type is a pre-welded panel where the horizontal rails are welded to the pickets and then attached to the posts by welding or by the use of a fastener. The other type of panel requires the rails and pickets to be assembled with a usually complicated system of screws, bolts, nails, rivets, pins, clips, brackets, or rods.

Most fence systems in use today do not appear the same from both sides. For example, a welded fence panel typically has the pickets welded to one side of the rails. This produces an inside and an outside view of the fence panel that differ. Similarly, with a fence panel that uses screws to fasten the pickets to the rails, the screw heads are typically visible on one side only.

Constructing a welded fence requires skilled welding labor and welding equipment at the jobsite. The skill and equipment necessary to weld a fence is in many cases beyond the do-it-yourself person. However in some areas high shipping costs can preclude shipping pre-welded panels.

In response, fence panels have been developed that require no welding and are completely assembled in the field. These designs can be shipped more economically by carriers that cannot carry a large panel assembly. However, these fencing kits typically require the use of screws, nails, rivets, pins, clips, brackets, or rods to assemble the rails and the pickets. On the jobsite these various fastening methods require an installer to assemble an array of components, for example, by drilling holes and installing screws, bolts, or clips to retain the pickets and/or rails in place. Lost or non-included fasteners, especially specialized fasteners, must be ordered and can delay the installation. Fasteners can be installed incorrectly and installation can require specialized tools for the specific fence system. Further, the more parts required for the fence system, the higher the cost, not only in manufacturing, but assembly as well. Panels that are assembled in the field by welding are also available however, welded panels must be rust-proofed (e.g., painted) in the field to repair the weld area. Typically, the more jobsite welding, the more difficult it becomes to maintain quality control.

There is a need for a simple fence system for a do-it-yourself individual or even a contractor that allows for shorter installation times, less training, and more efficient transportation, as well as lower cost and ease of manufacture.

SUMMARY OF THE INVENTION

The present invention is directed to an interlocking fence system and a method of assembling the same. By employing pickets that interlock with the rails, the use of fasteners or other attachment hardware can be minimized or even avoided altogether. Assembly is simplified, and the pickets, rails, posts and other component parts can be easily transported to the installation site. The interlocking system is ideal for the do-it-yourselfer and contractor.

In one embodiment, the interlocking fence system can include first and second spaced-apart upright posts attached to a grade. A locking rail and an alignment rail extend between the first and second posts. The system includes a picket with a transverse profile and a locking slot extending inwardly from a side surface thereof. A plurality of alignment apertures are provided in the rails comprising at least one alignment aperture in the alignment rail and a locking aperture formed in the locking rail. The alignment apertures have a profile matching the transverse profile of the picket to receive the picket and are in upright alignment to restrict lateral movement of the picket. The locking aperture has a profile to receive the picket at an angle offset from an axis of the alignment apertures. A lateral offset of the locking aperture from the alignment apertures defines a tab for insertion to the locking slot when the picket is aligned by the alignment apertures. A depth of the locking slot can be at least equal to the lateral offset of the locking aperture.

In an embodiment, the fence system can include a stop disposed in the support aperture on a side of the locking rail opposite the retaining slot.

In another embodiment, the locking rail can be tubular and the locking aperture can be formed in an upper surface thereof. At least one alignment aperture can be formed in a lower surface of the locking rail.

In yet another embodiment, the alignment rail can be a U-channel with at least one alignment aperture.

In another embodiment, the alignment rail can be tubular with at least one alignment aperture formed in an upper surface thereof, and optionally another in a lower surface thereof.

In yet another embodiment, the interlocking fence system can include a plurality of the pickets, each with a corresponding locking aperture and plurality of alignment apertures formed in the rails to receive the picket.

In another embodiment, the interlocking fence system can further comprise an inwardly extending retaining slot formed in a side surface adjacent one or both ends of the locking rail to receive a respective edge of a support aperture in a respective post.

In an embodiment, the fence system can include a stop inserted in the support aperture on a side of the locking rail opposite the retaining slot to inhibit release of the edges of the support apertures from the retaining slots. Alternatively or additionally, the fence system can include an end stop inserted in at least one of the posts adjacent the end of the respective locking rail to inhibit axial movement of the locking rail. In one embodiment, the end stop comprises a successive locking rail engaged in a successive support aperture opposite the respective first or second support aperture.

In yet another embodiment, the interlocking fence system can include an inwardly extending retaining slot formed in a side surface adjacent one or both ends of the alignment rail to receive a respective edge of a support aperture in a respective post.

In an embodiment, the fence system can include a stop inserted in the locking aperture on a side of the locking rail opposite the locking slot to inhibit release of the edges of the locking apertures from the locking slots. Alternatively or additionally, the fence system can include an end stop inserted in at least one of the posts adjacent the end of the respective alignment rail to inhibit axial movement of the alignment rail. In one embodiment, the end stop comprises a successive alignment rail engaged in a successive support aperture opposite the respective first or second support aperture. In one embodiment, the posts are tubular and the method includes filling the posts adjacent the support apertures with a hardenable filler such as cement, for example.

In another embodiment, a method of assembling the interlocking fence system can include the following steps: (a) inserting the picket through the locking aperture and a first one of the alignment apertures in the locking rail at an offset angle to position the locking slot adjacent the tab, (b) pivoting the picket about the first alignment aperture from the offset angle to an alignment angle to engage the tab into the locking slot, (c) and inserting the picket through a second one of the alignment apertures in the alignment rail.

In another embodiment, the method can further include installing first and second upright, laterally spaced posts in a grade, securing opposite ends of the locking rail to the posts, and securing opposite ends of the alignment rail to the posts, wherein the alignment rail is vertically spaced from the locking rail. In one embodiment, the locking rail is secured to the posts before the alignment rail, for example, the locking rail is secured to the posts in advance of step (c), preferably in advance of step (a), and the alignment rail is secured to the posts after step (c).

Securing the opposite ends of the locking rail can include disposing one of the ends of the locking rail into a support aperture in one of the posts to position a retaining slot formed in the rail adjacent an edge of the support aperture, and moving the locking rail transversely, preferably downwardly, to engage the edge in the retaining slot. In one embodiment, the locking rail has a said retaining slot formed adjacent both ends, preferably at an equal distance from each end, and a spacing between the retaining slots corresponds to a spacing between support apertures formed in the first and second posts.

In an embodiment, the support aperture in the first post has a depth that is at least equal to the sum of the respective distances from the ends of the locking rail to the respective retaining slots, and the method includes the following steps: (1) inserting a first end of the locking rail into the first support aperture while the second end is positioned laterally to one side of the second post, preferably adjacent the second support aperture, to provide clearance between the second end of the locking rail and the second post; (2) laterally pivoting the second end of the locking rail into alignment with the second support aperture in the second post; (3) moving the locking rail axially to position the first and second retaining slots adjacent respective edges of the first and second support apertures; and (4) moving the locking rail laterally, preferably downwardly, to engage the respective edges of the first and second support apertures in the first and second retaining slots.

The method can also include inserting stops into the first and second support apertures on a side of the locking rail opposite the respective first and second retaining slots to inhibit release of the edges of the support apertures from the retaining slots. Alternatively or additionally, the method can include inserting an end stop in at least one of the posts adjacent the end of the respective locking rail to inhibit axial movement of the locking rail. In one embodiment, the end stop comprises a successive locking rail engaged in a successive support aperture opposite the respective first or second support aperture. In another embodiment, the posts are tubular and the method includes filling the posts adjacent the support apertures with a hardenable filler such as cement, for example.

Securing the opposite ends of the alignment rail can include disposing one of the ends of the alignment rail into a support aperture in one of the posts to position a retaining slot formed in the rail adjacent an edge of the support aperture, and moving the alignment rail transversely, preferably downwardly, to engage the edge in the retaining slot. In one embodiment, the alignment rail has a said retaining slot formed adjacent both ends, preferably at an equal distance from each end, and a spacing between the retaining slots corresponds to a spacing between support apertures formed in the first and second posts.

In an embodiment, the support aperture in the first post has a depth that is at least equal to the sum of the respective distances from the ends of the alignment rail to the respective retaining slots, and the method includes the following steps: (1) inserting a first end of the alignment rail into the first support aperture while the second end is positioned laterally to one side of the second post, preferably adjacent the second support aperture, to provide clearance between the second end of the alignment rail and the second post; (2) laterally pivoting the second end of the alignment rail into alignment with the second support aperture in the second post; (3) moving the alignment rail axially to position the first and second retaining slots adjacent respective edges of the first and second support apertures; and (4) moving the alignment rail laterally, preferably downwardly, to engage the respective edges of the first and second support apertures in the first and second retaining slots.

The method can also include inserting stops into the first and second support apertures on a side of the alignment rail opposite the respective first and second retaining slots to inhibit release of the edges of the support apertures from the retaining slots. Alternatively or additionally, the method can include inserting an end stop in at least one of the posts adjacent the end of the respective alignment rail to inhibit axial movement of the alignment rail. In one embodiment, the end stop comprises a successive alignment rail engaged in a successive support aperture opposite the respective first or second support aperture.

DETAILED DESCRIPTION

Figure 1:
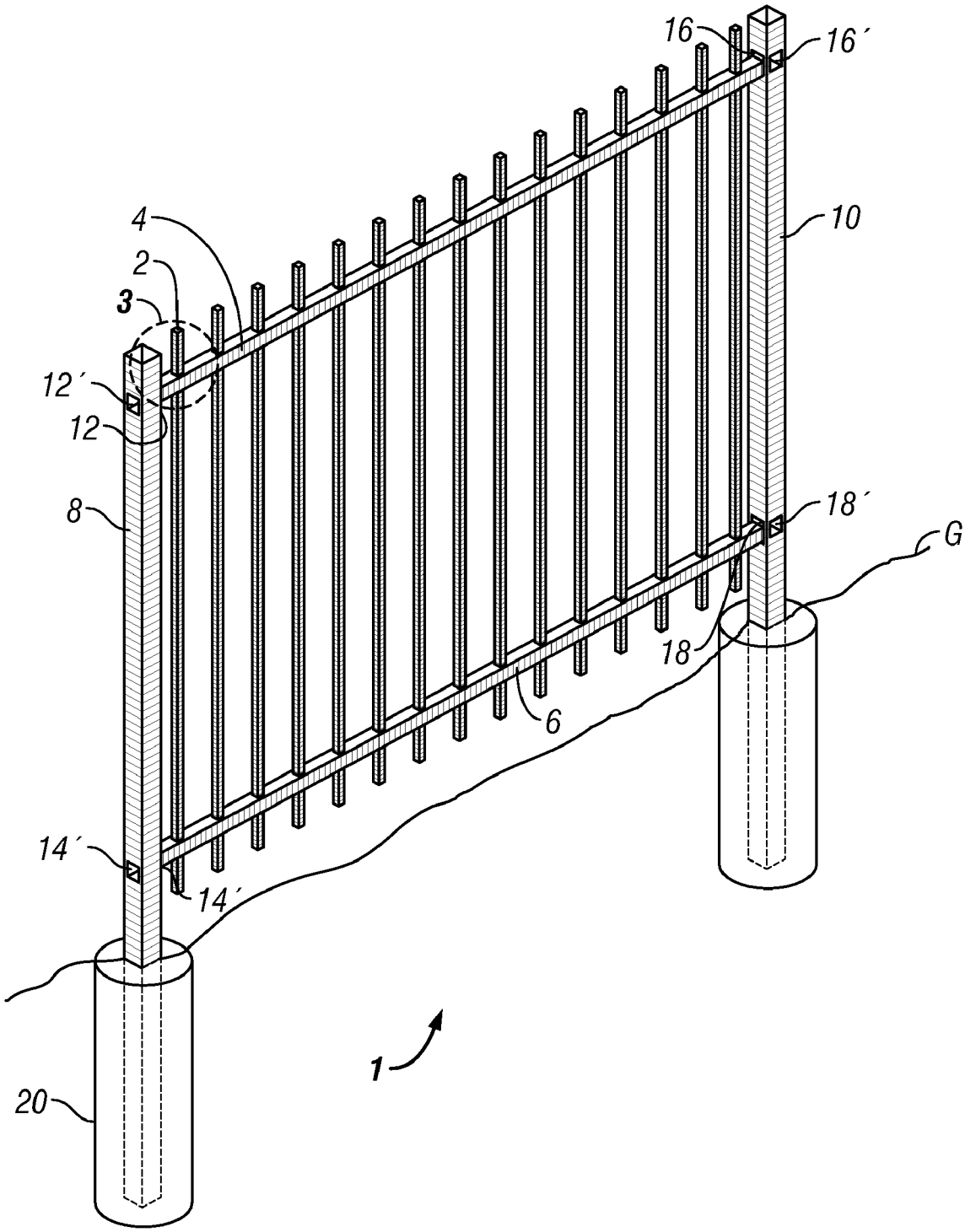
FIG. 1 is a perspective view of a section of an assembled interlocking fence system, according to one embodiment of the invention.

With reference to the figures wherein like reference numerals are used to refer to like parts, FIG. 1 shows a section of an interlocking fence system 1. Two spaced-apart upright posts (8, 10) are attached at grade G by cement 20, however any mooring means can be used. A locking rail 4 and an alignment rail 6 extend between the posts (8, 10). The rails (4, 6) can attach to the posts (8, 10) through any means known the art. The rails (4, 6) are both illustrated as being retained in support apertures (12,14; 12',14' in first post 8) (16,18; 16',18' in second post 10).

Figure 2:
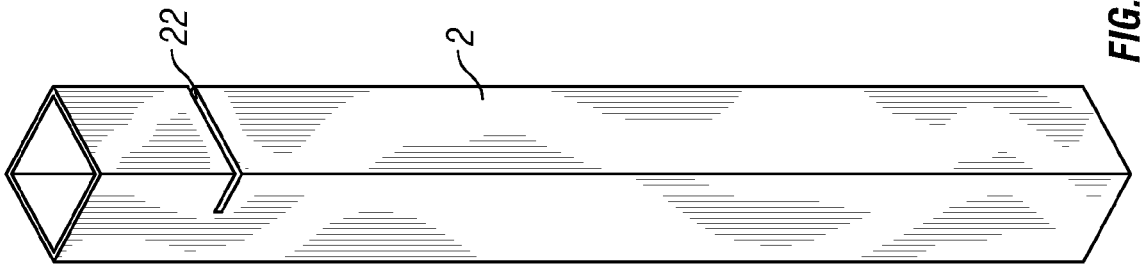
FIG. 2 is a perspective view of a picket with a locking slot, according to one embodiment of the invention.

FIG. 2 illustrates a picket 2, with a locking slot 22 extending inwardly from a side surface of the picket 2. The picket 2, posts (8, 10), and rails (4, 6) can be solid in cross-section or tubular and/or U-shaped as illustrated, and the forming of slots is known by one of ordinary skill in the art. Further, an ornamental cap or any other ornamental accouterment (not shown) can be added to the picket 2 without departing from the spirit of the invention.

Figure 3:
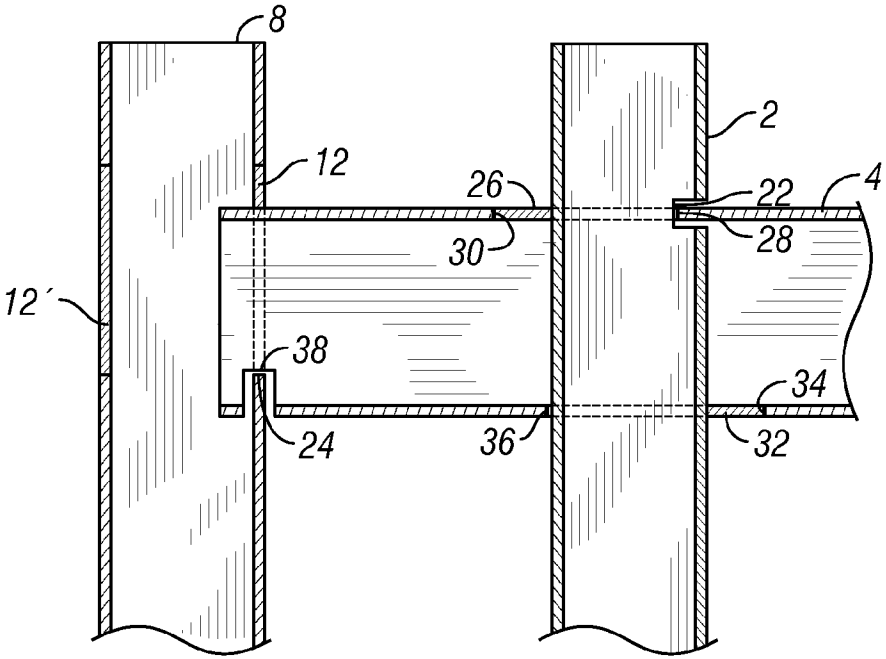
FIG. 3 is a cross-sectional view of the circled portion of the interlocking fence system of FIG. 1, as marked with a 3.

FIG. 3 is a cross-sectional view of circled area 3 in FIG. 1. Locking rail 4 is shown engaged with a picket 2. Locking rail 4 has a locking aperture 26 formed in an upper surface thereof. Edge 28 of the locking aperture 26 in locking rail 4 serves as a tab to restrict axial movement by insertion into the locking slot 22 on the picket 2. The picket 2 is also disposed through alignment aperture 32 formed in the lower surface of the locking rail 4. Edge 36 of alignment aperture 32 provides a profile matching that of the picket 2 to restrict the lateral movement of the picket 2. The interaction of the picket 2 and the alignment rail 6 (FIG. 1) is discussed below in reference to FIGS. 7-8.

Locking rail 4 is supported by the support aperture 12 formed in post 8. Edge 38 of support aperture 12 thus forms a tab to insert into the inwardly extending retaining slot 24 formed in the locking rail 4. Referring again to FIG. 1, a respective retaining slot (24' in FIG. 7) on an opposing end of the locking rail 4 allows for support by an edge of a support aperture 16 formed in the post 10 so locking rail 4 can be supported by the posts (8, 10). Further, the alignment rail 6 can be supported in similar fashion. Support apertures (12,14; 12',14' in first post 8) (16,18; 16',18' in second post 10) can be formed in opposing sides of each post as on post 8 or formed on adjacent sides as on post 10, for example, a corner post. Further, support apertures can be formed on any of the sides of a post (8, 10), without departing from the spirit of the invention. Although FIG. 3 illustrates adjacent support apertures (12, 12') being formed at the same height, one skilled in the art will readily understand that the support apertures can be formed at any height, independent of any other support apertures present.

Figure 4:
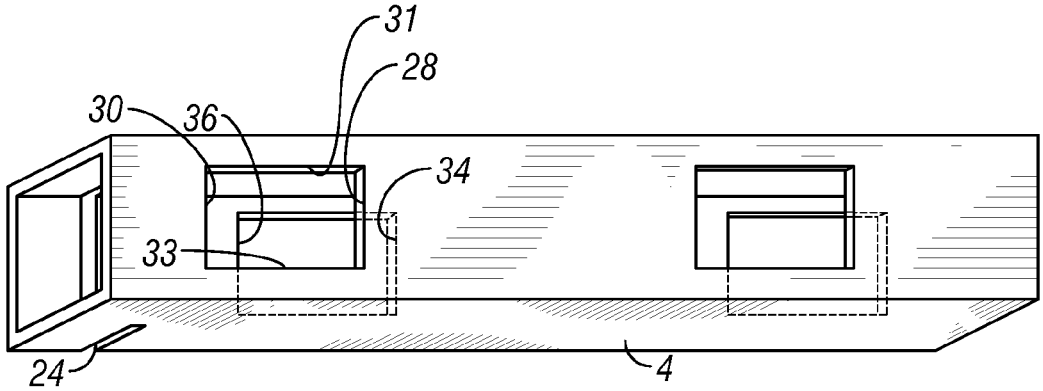
FIG. 4 is a perspective view of a locking rail, according to one embodiment of the invention.

FIG. 4 is a top perspective view of the locking rail 4, showing the lateral offset of the locking aperture 26 with opposing edges (28, 30) and an alignment aperture 32 with opposing edges (34, 36).

Figure 5:
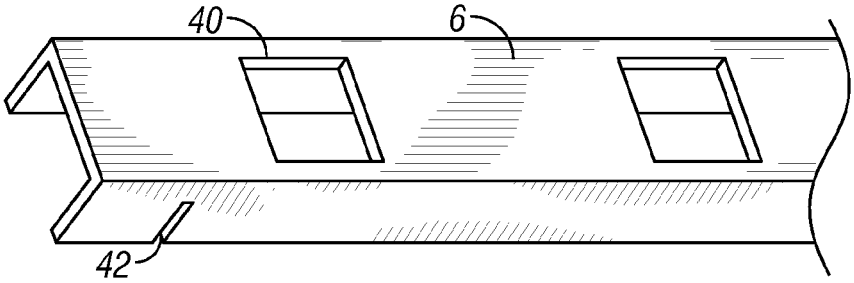
FIG. 5 is a perspective view of an alignment rail, according to one embodiment of the invention.

FIG. 5 is a top perspective view of the alignment rail 6. Alignment rail 6 has an alignment aperture 40 which can be sized so as to slidably receive picket 2, but restrict lateral movement thereof. Although alignment aperture 40 is shown in the upper surface thereof, the alignment rail 6 can be tubular or inverted so that an alignment aperture 40 is additionally or alternatively along the bottom surface, however, the retaining slot 42 can then be formed in the opposite surface as is illustrated. Although shown as a U-channel rail, any shape of rail can be used. For example, a tube similar to the illustrated locking rail 4 can be used, with the alignment aperture 40 formed in the tube to create a rectangular bore through the tube or, if hollow, a set of adjacent, non-offset, alignment apertures can be formed in the upper and lower surface. Alignment aperture 40 need not have the same profile as alignment aperture 32, especially if the picket does not have a uniform profile.

Figure 6:
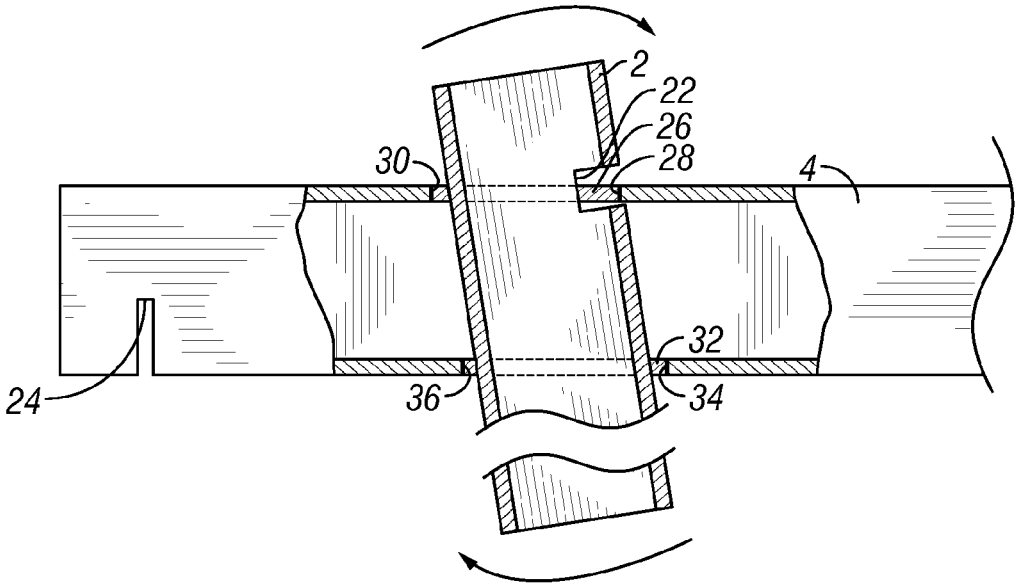
FIG. 6 is a partial cross-sectional and partial perspective view of a picket inserted into locking rail, according to one embodiment of the invention.

Turning now to FIG. 6, one step of assembly of the interlocking fence system is shown. A picket 2 is disposed through the locking aperture 26 and the alignment aperture 32. Locking aperture 26 is laterally offset from alignment aperture 32, preferably at a length equal to the depth of the locking slot 22, shown more readily in FIG. 4. The profiles of the locking aperture 26 and/or alignment aperture 32 are sized to allow the disposition of the picket 2 at an offset angle. Thus, edge 30 of rectangular locking aperture 26, and edge 34 of the rectangular alignment aperture 32, can be spaced from opposing edge 28 and opposing edge 36, respectively, to allow sufficient play for the passage of the picket 2. The transverse profile of the picket 2 and the profiles of the apertures (26, 32) can be selected to enable the picket 2 to be inserted into the locking rail 4 at an angle with respect to an axis defined by the alignment apertures.

Picket 2 is inserted into the locking aperture of the locking rail 4 until edge 28, which forms the insertion tab, is adjacent locking slot 22. The picket 2 can then be pivoted into alignment with the axis of the alignment apertures, preferably vertically, until the locking slot 22 engages a desired edge 28 of the offset locking aperture 26. The edge 36 of alignment aperture 32 is spaced so as to contact picket 2, preferably when the picket is substantially perpendicular to the locking rail 4. Referring to the orientation shown, any proximal or distal movement is impeded by the opposing edges (31, 33 in FIG. 4) which can be spaced relatively close to the transverse profile of picket 2, whereas the distance between the other set of opposing edges (for example, 28, 30) can be spaced larger than the transverse profile of the picket 2 to allow for the passage of the picket 2 through the aperture (for example, 26). Edge 30 can also be spaced to allow locking slot 22 of the picket 2 to become unengaged from edge 28 of the locking aperture 26. The picket can be installed through the apertures (26, 32) in any order. Further, any number of pickets can be installed, with a respective locking aperture 26 and an alignment aperture 32 formed in the locking rail 4, and an alignment aperture 40 formed in the alignment rail 6.

Figure 7:
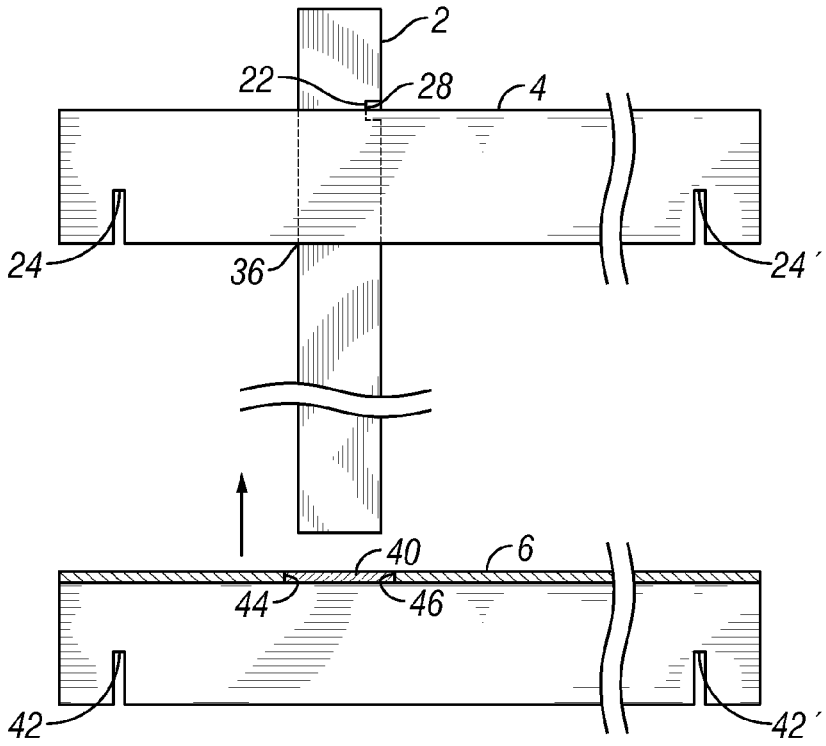
FIG. 7 is a schematic view of a picket connected to the locking aperture of the locking rail and an alignment rail being disposed towards the picket, according to one embodiment of the invention.

FIG. 7 shows the picket 2 installed in the locking rail 4, which includes retaining slots (24, 24') formed in adjacent each end. Due to the spacing and geometry of the picket 2 and locking aperture 26, picket 2 is retained in the locking rail 4. In the orientation shown, clockwise movement between the picket 2 and the locking rail 4 would be impeded by the interaction of the outer surface of picket 2 and edge 36 of alignment aperture 32 as well as the interaction of the inner edge of the locking slot 22 and the edge 28 of the locking aperture 26. However, counterclockwise movement of the picket 2 relative to the locking rail 4 can cause the locking slot 22 to become disengaged from the edge 28 of the aperture 26 formed in the locking rail 4 (as shown in FIG. 6). To further retain the picket 2 within the locking rail, the invention provides an alignment rail 6. Alignment rail 6 includes an alignment aperture 40, shown here as a U-channel rail. The picket 2 can be inserted through alignment aperture 40, here by disposing alignment rail 6. The profile of alignment aperture 40 can be substantially similar to that of the transverse profile of the picket 2, preferably providing a gap therebetween to facilitate insertion of the picket 2 into the alignment aperture 40. Adjacent edges (44, 46) can be spaced relatively closer than the adjacent edges (34, 36) of the alignment aperture 32 in the locking rail 4 because the picket 2 can be inserted perpendicular to the alignment aperture 40.

Figure 8:
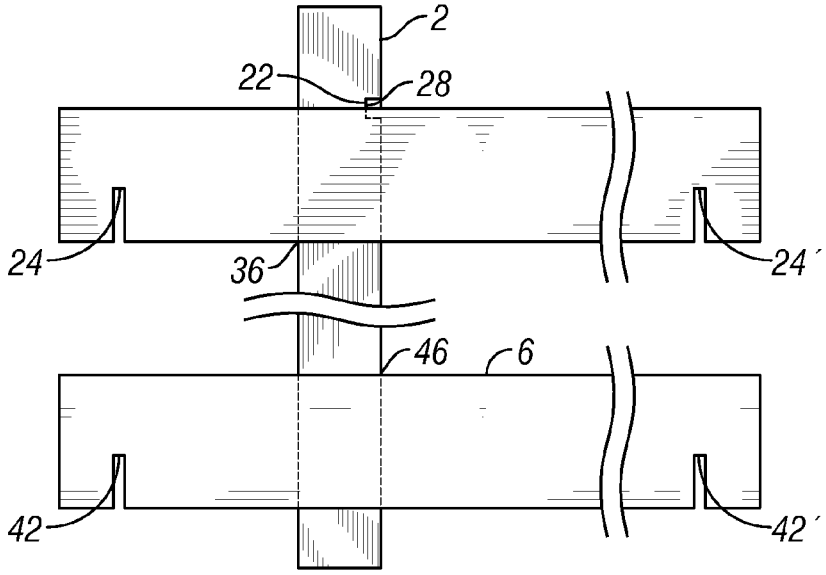
FIG. 8 is a schematic view of a picket installed in a locking and an alignment rail, according to one embodiment of the invention.

FIG. 8 illustrates the picket 2, locking rail 4, and alignment rail 6 in interlocked position, assuming the rails (4, 6) are fixed to the posts (8,10 in FIG. 1). The interaction of the outer surface of the picket 2 and edge 46 of the alignment aperture 40 in the alignment rail 6 can inhibit any counterclockwise movement, and thus create an interlocked picket 2, locking rail 4, and alignment rail 6 without the use of any fasteners or welding therebetween. Although shown with the locking aperture 26 formed in the upper surface of the locking rail 4 and the locking rail 4 being the upper rail in the system, the invention is not so limited. A picket with at least one locking slot and any two rails including at least two alignment apertures and at least one locking aperture can be used to inhibit axial and lateral movement to create an interlocked fence system. Similarly, three rails one with a locking aperture and two with an alignment aperture can be used without departing from the spirit of the invention. It is the interaction of the offset locking aperture 26 and the locking slot 22 and the picket 2 and two edges (36, 46) of the alignment apertures (32, 40) that creates the interlock. Further, any number of locking rails 4, locking slots 22 in a picket 2, and/or alignment rails 6 can be utilized with each individual picket (e.g., a plurality of alignment rails can be added).

Figure 9A:
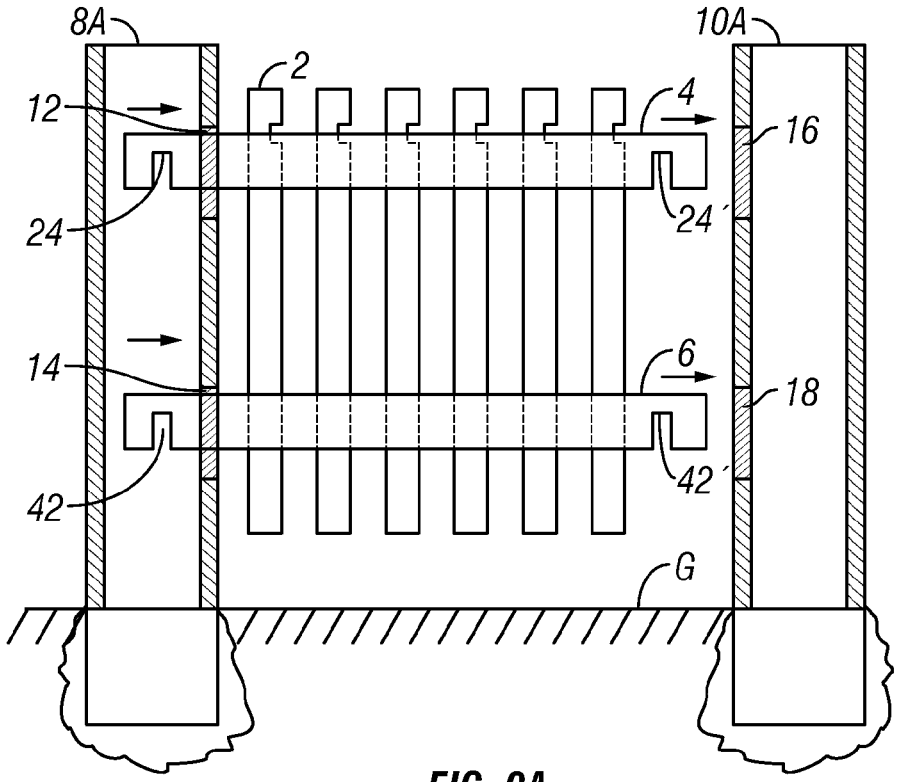
FIG. 9A is a cross-sectional schematic view of the ends of a locking rail and an alignment rail, supporting a plurality of interlocked pickets, disposed into respective support apertures in a first post, according to one embodiment of the invention.
Figure 9B:
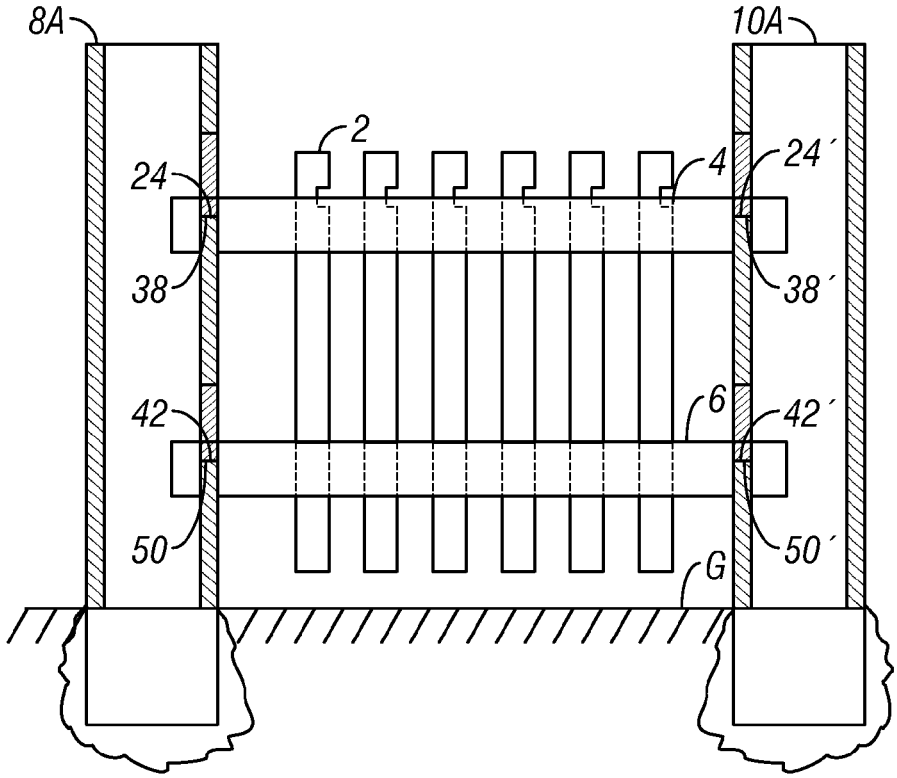
FIG. 9B is a cross-sectional schematic view of the interlocking fence system of FIG. 9A wherein the opposing ends of the locking rail and the alignment rail have been inserted into respective support apertures in the second post and the rails are supported by a retaining slot therein resting on an edge of each support aperture.

FIGS. 9A-9B illustrate the mounting of the rails (4, 6) to posts (8A, 10A) without the use of fasteners or welding. Each post (8A, 10A) can have multiple support apertures to mount other sections fence, as is described above. Upright and spaced-apart posts are attached to grade G by any means known the art. In FIG. 9A, a locking rail 4 and an alignment rail 6 are interlocked with pickets 2, as is described above. The ends of the rails can then be disposed within a support aperture formed in each post. The end of the locking rail 4 with retaining slot 24 formed therein is disposed within the support aperture 12 formed in the post 8A. The locking rail 4 can then be displaced within the post 8A until there is sufficient clearance between the opposite end of the locking rail and the post 10A, and the opposite end of the locking rail 4 can be moved laterally into alignment and inserted into the support aperture 16 formed in post 10A by moving the locking rail axially. The locking rail 4 can then be axially displaced toward post 10A until both retaining slots (24, 24') are disposed into contact with an edge (38, 38') of the respective support aperture (12, 16).

Similarly, the end of the alignment rail 6 with retaining slot 42 formed therein is disposed within the support aperture 14 formed in the post 8A. The alignment rail 6 can then be displaced within the post 8A until the opposite end of the alignment rail 6 can be inserted into the support aperture 18 formed in post 10A. The alignment rail 6 can then be displaced toward post 10A until both retaining slots (42, 42') are disposed into contact with an edge (50, 50') of the respective support aperture (14, 18). The fence can thus be used for temporary or permanent purposes. With a temporary use, a post can be moored to the grade by any means known in the art, for example, a removable, weighted pedestal. If hollow posts (8A, 10A) are utilized, as shown, a post can be filled with a hardenable filler, for example, cement, adjacent a support aperture to more permanently attach a rail (4, 6) to a post (8A, 10A).

The combination of the retaining slots (24,24'; 42,42'), support apertures (12, 14, 16, 18), and gravity thus retain the rails (4, 6) and interconnected pickets 2 to the posts (8A, 10A). Although four pickets are shown, and number can be used without departing from the spirit of the invention. The retaining slots (24,24'; 42,42') and support apertures (12, 14, 16, 18) can be designed to allow the insertion and displacement above, as is known to one of ordinary skill in the art.

Although FIGS. 9A-9B illustrate the pickets 2 installed before installing the locking 4 and alignment rails 6 to the posts (8A, 10A), either rail (4, 6) can be installed to a post, of both posts (8A, 10A) independently of each other and/or the presence of a picket 2. Similarly, the locking rail 4 can be installed to the posts (8A, 10A), the pickets 2 installed in the locking rail 4, the alignment rail 6 installed to the pickets 2, and the alignment rail 6 installed to the posts (8A, 10A). Further, multiple posts, rails, and pickets can be used to form any desired length of fence comprising multiple sections of the interlocking fence section 1 shown in FIG. 1. For example, the fence section shown of FIGS. 9A-9B can be constructed by first installing the posts (8A, 10A) to the grade G, such as by recessing in a cement hole. The locking rail 4 can then attached to both left and right posts (8A, 10A). Preferably, the locking rail 4 has a retaining slot (24, 24') formed adjacent both ends, preferably at an equal distance from each end, and a spacing between the retaining slots (24, 24') corresponds to a spacing between support apertures (12, 16) formed in the first and second posts. The support aperture 12 in the first post 8A, which can be hollow or solid, preferably has a depth that is at least equal to the sum of the respective distances from the ends of the locking rail 4 to the respective retaining slots (24, 24'). To install the locking rail 4, a user can insert a first end of the locking rail 4 into the first support aperture 12 while the second end is positioned laterally to one side of the second post 10A, preferably adjacent the second support aperture 16, to provide clearance between the second end of the locking rail 4 and the second post 10A. A user can then laterally pivot the second end of the locking rail 4 into alignment with the second support aperture 16 in the second post 10A and move the locking rail 4 axially to position the first 24 and second 24' retaining slots adjacent respective edges (38, 38') of the first 12 and second 16 support apertures. Further, a user can move the locking rail 4 laterally, preferably downwardly, to engage the respective edges (38, 38') of the first and second support apertures (12, 16) in the first and second retaining slots (24, 24'). Next, a picket 2 or plurality of pickets, can be installed in the locking rail 4, as described above.

Finally, the pickets 2 can be installed to the alignment rail 6 and the alignment rail attached to the posts (8A, 10A). For example, the alignment rail 6 can be disposed adjacent to the posts (8A, 10A) and the lower ends of the pickets 2. The alignment rail can by disposed toward the ends of each picket 2 and the ends of a picket 2 can then be disposed laterally, which can be facilitated by the gap formed between each picket 2 and locking rail 4 apertures, to insert each picket 2 through a respective alignment aperture 40 (or apertures) in the alignment rail 6. After each picket 2 is installed, the alignment rail 6 can be attached to both left and right posts (8A, 10A). Preferably, the alignment rail 6 has a retaining slot (42, 42') formed adjacent both ends, preferably at an equal distance from each end, and a spacing between the retaining slots (42, 42') corresponds to a spacing between support apertures (14, 18) formed in the first and second posts. The support aperture 14 in the first post 8A, which can be hollow or solid, preferably has a depth that is at least equal to the sum of the respective distances from the ends of the alignment rail 6 to the respective retaining slots (42, 42'). To install the alignment rail 6, a user can insert a first end of the alignment rail 6 into the first support aperture 14 while the second end is positioned laterally to one side of the second post 10A, preferably adjacent the second support aperture 18, to provide clearance between the second end of the alignment rail 6 and the second post 10A. Then a user can laterally pivot the second end of the alignment rail 6 into alignment with the second support aperture 18 in the second post 10A and move the alignment rail 6 axially to position the first 42 and second 42' retaining slots adjacent respective edges (50, 50') of the first 14 and second 18 support apertures. Further, a user can move the alignment rail 6 laterally, preferably downwardly, to engage the respective edges (50, 50') of the first and second support apertures (14, 18) in the first and second retaining slots (42, 42'). Alternatively, the pickets 2, alignment rail 6, and locking rail 4 can be interlocked before insertion of the ends of each rail (4, 6) to each post (8A, 10A) in the manner described above.

As each post (8, 10) can have multiple support apertures (12',14'; 16', 18' in FIG. 1), further sections of fence can be added, for example by adding a third post (not shown).

Referring to FIGS. 1-9B, the fence system can include a stop (not shown) made of any material, for example, elastomer, that is inserted in the locking aperture 26 on a side of the locking rail 4 opposite the locking slot 22 of an installed picket 2 to inhibit release of the edge 28 of the locking aperture 26 from the locking slot 22. A stop can be inserted into a support aperture (12, 14, 16, 18) on a side of a installed rail (4, 6) opposite a respective retaining slot (24, 42, 24', 42') to inhibit release of the edges (38, 50, 38', 50') of the support apertures (12, 14, 16, 18) from the retaining slots (24, 42, 24', 42'). Alternatively or additionally, the fence system can include an end stop (not shown) inserted in at least one of the posts (8, 10) adjacent the end of the respective rail (4, 6) to inhibit axial movement of the rail. In one embodiment, the end stop can be a successive alignment rail (not shown) engaged in a successive support aperture (e.g., 12', 14', 16', 18') opposite a respective support aperture (12, 14, 16, 18). In one embodiment, the posts (8, 10) are tubular and the end stop can be formed by filling the posts (8, 10) adjacent a support aperture (12, 14, 16, 18) with a hardenable filler such as cement, for example.

The disclosed interlocking fence system can allow simple manufacturing, for example, by sawing and/or hole punching. No damage to the protective coating during assembly as there are no fasteners, for example, screws, or welding to damage the rust protection, which can necessitate repair in the field. No tools are required for assembly. The interlocking panels formed by rails and pickets can follow the ground contour easily owing to the non-rigid manner of the interlock and are not limited to a stair step mounting as is with typical prefabricated welded panels. The interlocking fence system allows visual symmetry as both sides of the fence look the same. The size of each interlocked panel and/or the entire interlocking fence system can be scaled up or down for residential, commercial and industrial applications.

Figure 10:
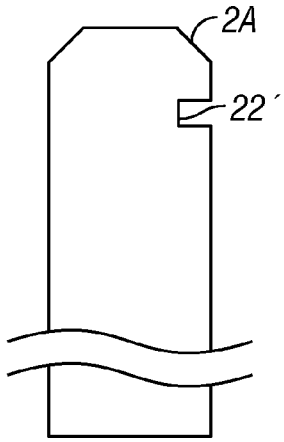
FIG. 10 is a perspective view of a picket, according to a second embodiment of the invention.
Figure 11:
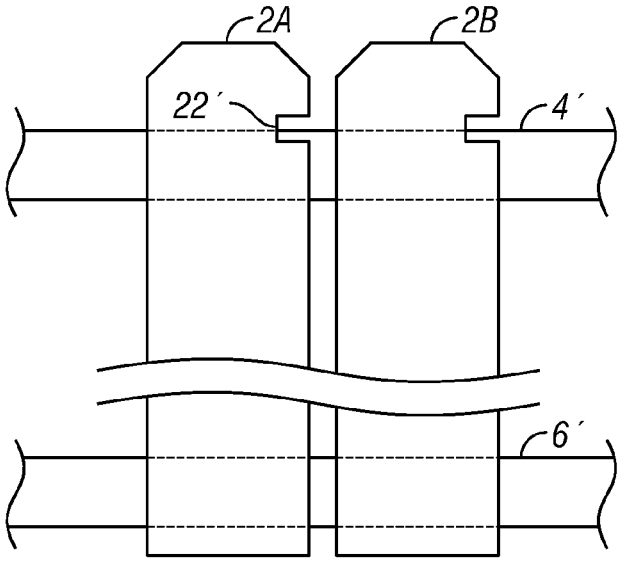
FIG. 11 is a schematic view of two adjacent pickets installed in a locking rail and an alignment rail, according to a second embodiment of the invention.
Figure 12:
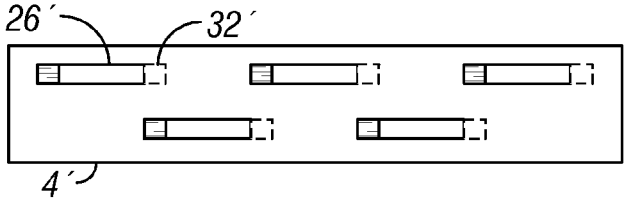
FIG. 12 is a top perspective view of the locking rail of FIG. 11, illustrating zigzag mounting pattern and the lateral offset of each set of a locking aperture and an alignment aperture.

Turning now to FIGS. 10-12, a second embodiment of pickets 2A is illustrated. The picket 2A, which can be solid, is representative of the kind typically used in a privacy fence, as is known to those skilled in the art. A locking slot 22 and locking can be formed in the picket 2A, as above. Two parallel rows of spaced pickets (2A, 2B) can be mounted in an offset pattern as seen in FIG. 12 using a locking rail 4' and an alignment rail 6' with similarly laterally offset locking apertures 26' and alignment apertures 32'. The pickets in each row are thus offset so that the pickets in one row are positioned opposite the spaces between the pickets in the other row so that there is no line of sight between the pickets and the inside and outside view of the fence panel does not differ.

Although illustrated with square or rectangular tubing and apertures, other profiles can be used without departing from the spirit of the invention, including, for example, circular or non-circular, ovate, polygonal, cylindrical, tapered, regular, irregular or the like, or various combinations thereof, including different profiles on the same or different pickets, rails, posts, and/or apertures. A picket, post, or rail can be any material, including, but not limited to, metal, wood, plastic, or the like, and various combinations and composites thereof. Each picket, rail, and/or post can be any length desired.

While the invention has been described with respect to a limited number of embodiments, those skilled in the art will appreciate numerous modifications and variations therefrom. It is intended that the appended claims cover all such modifications and variations as fall within the true spirit and scope of the invention.

What is claimed is:

1. An interlocking fence system comprising:

first and second spaced-apart upright posts attached to a grade;

a tubular locking rail and an alignment rail extending between the first and second posts;

a picket with a transverse profile and a locking slot extending inwardly from a side surface thereof, wherein the picket passes through the rails at a locking aperture and is then pivoted into alignment with an axis of a plurality of spaced apart, coaxial alignment apertures;

the plurality of alignment apertures in the rails comprising-at least one alignment aperture in the alignment rail and at least one alignment aperture is formed in a lower surface of the tubular locking rail, wherein the alignment apertures have a profile matching the transverse profile of the picket and are in upright alignment with respect to an axis of the picket to restrict lateral movement of the picket; and the locking aperture formed in the locking rail spaced from the alignment apertures and having a profile matching the transverse profile of the picket to receive the picket at an angle offset from an axis of the alignment apertures for assembly, wherein the locking aperture is offset laterally with respect to the axis of the picket, wherein the lateral offset of the locking aperture defines a tab inserted into the locking slot with the picket aligned by the alignment apertures.

2. The interlocking fence system of claim 1 wherein the locking rail is tubular and the locking aperture is formed in an upper surface thereof.

3. The interlocking fence system of claim 1 wherein the alignment rail is a U-channel with at least one alignment aperture.

4. The interlocking fence system of claim 1 further comprising a plurality of said pickets, each with a corresponding locking aperture and plurality of alignment apertures formed in the rails receiving the picket.

5. The interlocking fence system of claim 1 wherein a depth of the locking slot is at least equal to the lateral offset of the locking aperture.

6. The interlocking fence system of claim 1 further comprising a stop inserted in the locking aperture on a side of the locking rail opposite the locking slot to inhibit release of an edge of the locking aperture from the locking slot.

7. The interlocking fence system of claim 1 further comprising inwardly extending retaining slots formed in a side surface adjacent an end of the locking and alignment rails to receive a respective edge of a support aperture in a respective post.

8. The interlocking fence system of claim 7 further comprising stops disposed in the support aperture on a side of the locking and aligning rails opposite the retaining slots to inhibit release of the edge of the support aperture from the retaining slot.

9. The interlocking fence system of claim 8 further comprising end stops inserted in at least one of the posts adjacent the ends of the respective locking and alignment rails to inhibit axial movement of the locking and alignment rails.

10. The interlocking fence system of claim 9 wherein the end stops comprise successive locking and alignment rails engaged in a successive support aperture opposite the respective first support aperture.

11. The interlocking fence system of claim 7 wherein the locking and alignment rails have a said retaining slot formed adjacent both ends at an equal distance from each end, and a spacing between the retaining slots corresponds to a spacing between support apertures formed in the first and second posts.

12. The interlocking fence system of claim 11 wherein the support apertures in the first post have a depth that is at least equal to the sum of the respective distances from the ends of the locking and alignment rails to the respective retaining slots.

13. An interlocking fence system comprising:

first and second spaced-apart upright posts attached to a grade;

a locking rail and an alignment rail extending between the first and second posts, wherein the locking rail is tubular and has a rectangular cross section, wherein the locking rail and the alignment rail are horizontal and are vertically spaced apart;

a plurality of pickets having a rectangular cross section and a locking slot extending inwardly from a side surface thereof;

a like plurality of rectangular locking apertures formed in an upper surface of the locking rail;

a like plurality of first rectangular alignment apertures formed in a lower surface of the locking rail, wherein the first alignment apertures are laterally offset with respect to the locking apertures;

a like plurality of second rectangular alignment apertures formed in the alignment rail;

wherein the pickets are coaxially disposed in the alignment apertures;

wherein an edge of the locking apertures corresponding to the lateral offset is inserted into the locking slot of the pickets, wherein a depth of the locking slot is at least equal to the lateral offset;

wherein the pickets can be slideably received in the locking aperture and first alignment aperture at an angle with respect to the locking rail for assembly and then pivoted into alignment with the axis of the alignment apertures.

14. The interlocking fence system of claim 13 wherein the alignment rail is a U-channel.

15. The interlocking fence system of claim 13 further comprising a stop inserted in the locking apertures on a side of the locking rail opposite the locking slot to inhibit release of an edge of the locking aperture from the locking slot.

16. The interlocking fence system of claim 13 further comprising inwardly extending retaining slots formed in a side surface adjacent an end of the locking and alignment rails to receive a respective edge of a support aperture in a respective post.

17. The interlocking fence system of claim 16 further comprising stops disposed in the support aperture on a side of the locking and aligning rails opposite the retaining slots to inhibit release of the edge of the support aperture from the retaining slot.

18. The interlocking fence system of claim 17 further comprising end stops inserted in at least one of the posts adjacent the ends of the respective locking and alignment rails to inhibit axial movement of the locking and alignment rails.

19. The interlocking fence system of claim 18 wherein the end stops comprise hardenable filler in the posts.

20. The interlocking fence system of claim 16 wherein the locking and alignment rails have a said retaining slot formed adjacent both ends at an equal distance from each end, and a spacing between the retaining slots corresponds to a spacing between support apertures formed in the first and second posts, and wherein the support apertures in the first post have a depth that is at least equal to the sum of the respective distances from the ends of the locking and alignment rails to the respective retaining slots.

* * * * *